US005634499A

United States Patent [19]

Kikuchi et al.

[11] Patent Number: 5,634,499

[45] Date of Patent: Jun. 3, 1997

[54] WOVEN SAFETY BELT WITH ROPE-LIKE CONFIGURATION

[75] Inventors: Koichi Kikuchi, Shimada; Masao Watanabe, Haibara-gun, both of Japan

[73] Assignee: Kikuchi Web Tech Co., Ltd., Japan

[21] Appl. No.: 362,508

[22] PCT Filed: Dec. 27, 1993

[86] PCT No.: PCT/JP93/01908

§ 371 Date: Jan. 5, 1995

§ 102(e) Date: Jan. 5, 1995

[87] PCT Pub. No.: WO94/26963

PCT Pub. Date: Nov. 24, 1994

[30] Foreign Application Priority Data

May 6, 1993 [JP] Japan ..... 5-105664

[51] Int. Cl.[6] ..... D03D 1/00; D03D 11/00; D03D 3/02

[52] U.S. Cl. ..... 139/387 R; 139/384 R; 139/408; 428/36.1

[58] Field of Search ..... 139/384 R, 387 R, 139/388, 408; 264/173, 174; 428/257, 36.1, 36.2, 232

[56] References Cited

U.S. PATENT DOCUMENTS

| | | | |
|---|---|---|---|
| 4,015,641 | 4/1977 | Goff, Jr. et al. | 139/384 R |
| 5,080,142 | 1/1992 | Calamito et al. | 139/384 R |

FOREIGN PATENT DOCUMENTS

| | | | |
|---|---|---|---|
| 0279950 | 12/1987 | European Pat. Off. . | |
| 0498253 | 1/1992 | European Pat. Off. . | |
| 2643657 | 8/1990 | France | 139/384 R |
| 58-35671 | 8/1983 | Japan . | |
| 62-14137 | 4/1987 | Japan . | |
| 141149 | 6/1987 | Japan . | |
| 63-60482 | 4/1988 | Japan . | |
| 63-31576 | 6/1988 | Japan . | |
| 153777 | 4/1989 | Japan . | |
| 3045743 | 3/1991 | Japan | 139/387 R |
| 9203603 | 3/1992 | WIPO . | |

*Primary Examiner*—Andy Falik

*Attorney, Agent, or Firm*—Harris Beach & Wilcox, LLP

[57] ABSTRACT

A rope substitution belt which has a higher strength than a rope having the same mass, has a substantially circular section, and is equipped with belt portions for sewing on both sides. The belt is a narrow width woven fabric (10) including warps (6) and wefts (7) of synthetic fiber filaments. The belt includes a main body portion (2), a belt portion (4) and a connecting portion (3) for connecting the main body portion (2) to the belt portion (4), that are disposed in a longitudinal direction. The main body portion (2) has a structure with wadding yarns (5) which are woven into a hollow woven structure. The warp density coefficient in the hollow woven structure portion (22) is set to be not greater than 0.700. The belt portion (4) has a structure with a part, or the whole, of the wadding yarns (5) which are so arranged as to cross the wefts with the warps (6) of the hollow woven structure of the main body portion (2). The belt portion (4) has a width W which is at least 2.0 times the width W of the main body portion (2). The connecting portion (3) is constituted such that while the width is gradually changed, it step-wise shifts over a plurality of stages to the woven structure of the main body portion (2) or the belt portion (4).

9 Claims, 7 Drawing Sheets

(M = MIDDLE)

WOVEN SAFETY BELT WITH ROPE-LIKE CONFIGURATION

TECHNICAL FIELD

This invention relates to a belt-like woven fabric which can replace ropes used as a safety belt for work done in high places and ropes used as slings for flexible containers, and so forth.

DESCRIPTION OF RELATED ART

Generally, a safety belt for work done in high places has a construction wherein one of the ends of a rope is fitted to a metal member disposed in a safety belt and a hook or a carabiner is fitted on the other end thereof. In the sling of a flexible container, a rope is connected to a metal member fitted to the main body of the container. To connect the rope to the metal member, it is customary to conduct so-called "Satsuma" processing, i.e., a Japanese term representing an operation to piece together two ends of rope manually. This processing requires a high level of skill and strength. Accordingly, it has become difficult in recent years to secure such skilled labor. In the case of narrow woven fabrics, connection by sewing can be easily accomplished. However, because they are relatively wide, belt-like woven fabrics are inferior to rope in the aspect of handling, and have therefore not been employed.

A prior art reference disclosing a structure analogous to that of the present invention is Japanese Examined Utility Model Publication (Kokoku) No. 62-14137 entitled "Narrow Woven Fabric". This includes a narrow width flat woven structure 81 and a circular woven structure 82. When warps 83 at a peripheral portion are woven by wefts 85 in the circular woven structure 82, part of the warps 84 are used as core yarns, i.e., wadding yarns.

However, this prior art reference is substantially different from the construction of the present invention in the following points, and this technology cannot be employed for the object of the present invention. As described in the specification of this prior art reference, "a part of warps 84 is removed from the woven structure and weaving is done in such a manner that the number of warps to be woven is smaller on the inside of the woven structure than on the peripheral side thereof". The prior art does not weave the wadding yarns in a total denier number of at least 1.5 times the total denier number of the warps of the hollow woven structure as is done in the present invention. As will be later described, the wadding yarns to be woven into the hollow woven structure in the present invention must have at least the volume described above, and if the volume is smaller, the inside of the hollow woven structure will have a large number of spaces, the packing will not be sufficient, and the section will not become circular. Accordingly, the description of the prior art reference reading "the circular woven structure portion has a ropelike configuration, the inside portion of which is solid, and its cross-section is circular", is improbable, although this is difficult to ascertain, because the reference does not include examples; the reason will be explained as follows. FIGS. 5 and 6, for example, show a flat triple weave structure 81 and a circular string portion 82 formed by weaving the second layer of the woven structure 81 and connecting yarns, i.e., stitching yarns as wadding yarns. However, the wadding yarns comprise only one-third of the ground yarns and a very limited number of the connecting yarns. According to the judgement of those skilled in the art, such a structure cannot produce a product which can be used while its section remains circular.

Although various problems are left yet unsolved, the reference does not comment on them.

It is an object of the present invention to provide a narrow woven fabric which has a higher strength than a rope having the same mass, has a substantially circular cross-section and replaces a rope. In the present invention, the end portion of this narrow woven fabric is changed into a flat configuration having a wider width and a suitable thickness through the weaving operation, so that connection means by sewing can be employed.

The inventors of the present invention proposed in Japanese Patent Application No. 4-272842 entitled "Thick Belt and Production Apparatus Thereof", which is directed to "provide a narrow woven fabric having a thickness and a breaking strength beyond conventional expectation per a predetermined width", "a thick belt having a shape most approximate to the shape of a rope", and a method and means for "weaving the end portions of the belt into a wide width and a suitable thickness so that sewing can be carried out".

The invention of the prior patent application is characterized in that a woven structure has at least four plied layers by using a double-shuttle of a shuttle loom, and as illustrated in Example 1, a high strength of as high as 6,100 kgf is attained though the width is as small as 23.5 mm. In contrast, the present invention is directed to provide a product having substantially the same shape as that of the prior invention and corresponding to a relatively low required strength, by using a single shuttle of a shuttle loom or a single needle loom.

SUMMARY OF THE INVENTION

To attain the objects described above, the present invention employs the following technical construction. A rope substitution belt is provided including a main body portion, a belt portion and a connecting portion for connecting the main body portion to the belt portion which is disposed in a predetermined length in a longitudinal direction of the belt, respectively, as a narrow woven fabric constituted by warps and wefts of synthetic fiber filaments, wherein the main body portion has a structure wherein wadding yarns are woven into a hollow woven structure, the total denier number of the wadding yarns is so arranged as to be at least 1.5 times the total denier number of the warps of the hollow woven structure, the hollow woven structure portion is set to a warp density coefficient, defined in the present invention, of not greater than 0.700, the belt portion has a woven structure wherein a part, or the whole, of the wadding yarns of the main body portion are so arranged as to cross the wefts with the warps of the hollow woven structure portion of the main body portion, the belt portion further has a width of at least 2.0 times the width of the main body portion, and the connecting portion is constituted in such a manner that while the weave width of the woven structure thereof is gradually changed, the woven structure of the connection portion shifts step-wise over a plurality of stages to the woven structure of the main body portion or the belt portion.

In the rope substitution belt according to the present invention, at least the main body portion is subjected to heat-set processing so as to cause shrinkage of the wefts, or a predetermined impregnating synthetic resin is cured so as to improve handling and tensile strength. Thereafter, the main body portion 2 is preferably subject to a molding treatment using a heat-treating apparatus having a suitable mold.

The mold in the heat-treating apparatus comprises, for example, two members opposing each other, and a groove portion which has a predetermined shape and through which the main body portion 2 can be passed is disposed on at least the contact surface of each of the members opposing each other. Each of the mold members is equipped with temperature control means capable of regulating the temperature of the mold member and at the same time, is equipped with pressure variation means capable of regulating the pressing force. It is further preferred that each of the mold members is equipped with pressure duration regulation means.

Since the rope substitution belt according to the present invention employs the technical construction described above, the wadding yarns get together and are integrated into the main body portion, and the surface layer has a low warp density coefficient so that the wefts have a large margin for shrinkage and the wadding yarns can be easily wrapped. When the heat-treatment is carried out after weaving, a substantially circular section can be obtained. In the belt portion, on the other hand, the warps which are woven as the wadding yarns in the main body portion are woven out to the surface and the warp density coefficient is high. Accordingly, the width thereof is likely to be expanded, and the width thereof after the heat-treatment has a small shrinkage ratio, so that a shape advantageous for sewing processing can be obtained.

When the main body portion is heat-treated by the mold heat-treatment apparatus, it is forcibly compressed. Accordingly, a rope substitution belt having a high packing density and a circular section, which cannot be obtained by ordinary heat-set processing, can be obtained.

DETAILED DESCRIPTION OF THE PREFERRED EMBODIMENTS

Hereinafter, a concrete example of a rope substitution belt according to the present invention will be explained in detail with reference to the accompanying drawings.

Figure 1:
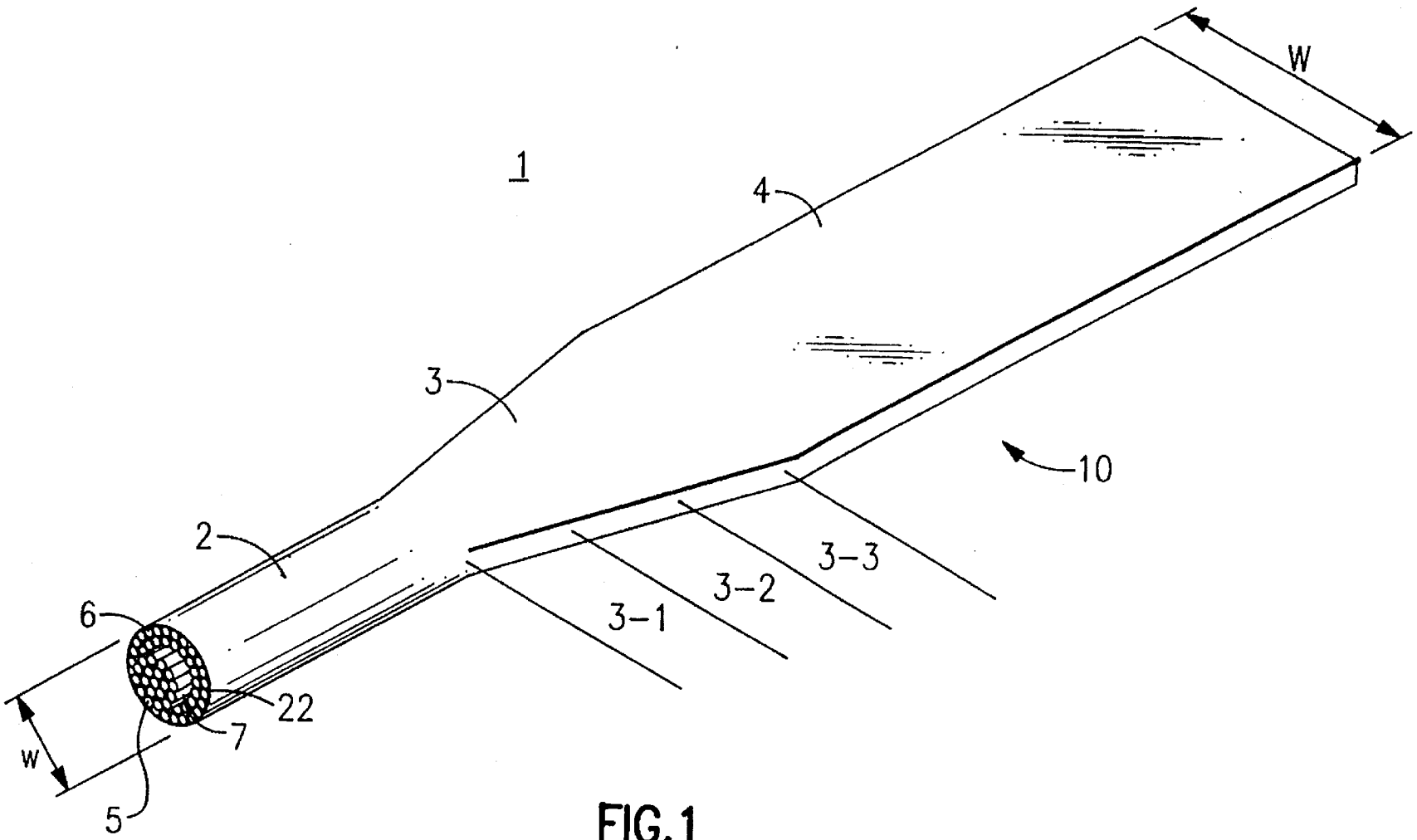
FIG. 1 is a perspective view useful for explaining the outline of a structural example of a rope substitution belt according to the present invention.
Figure 3:
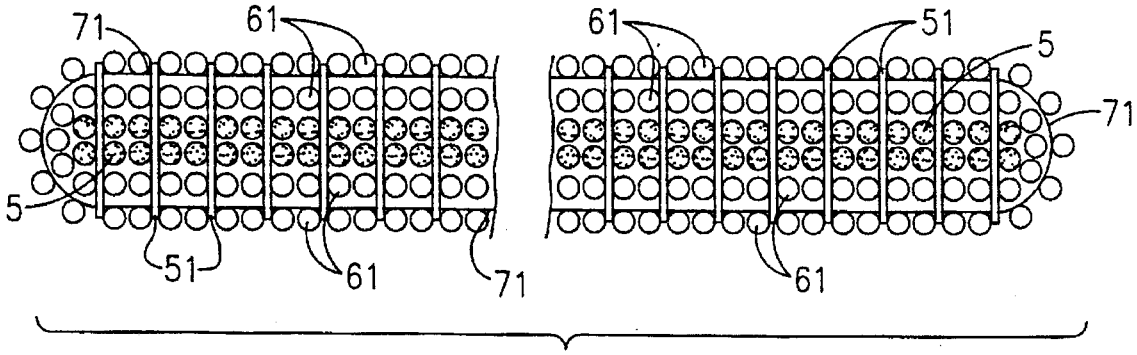
FIG. 3 is an enlarged view showing a structural example of a belt portion in the rope substitution belt according to the present invention.

FIG. 1 is a perspective view showing an example of the overall structure of the rope substitution belt 1 according to the present invention. In the drawing, the rope substitution belt 1 is a narrow width woven fabric 10 constituted by warps and wefts of synthetic fiber filaments, and includes a main body portion 2, a belt portion 4 and a connecting portion 3 for connecting the main body portion 2 to the belt portion 4, each of the portions having a predetermined length and formed in the longitudinal direction of the belt 1. The main body portion 2 has a structure in which wadding yarns 5 are woven into a hollow woven structure portion 22, and the total denier number of the wadding yarns 5 is so constituted as to be at least 1.5 times the total denier number of the warps 6 of the hollow woven structure portion 22. Further, a warp density coefficient, which is defined elsewhere in the present invention, of the hollow woven structure portion is set to be not greater than 0.700. FIG. 3 shows a cross-sectional configuration of the belt portion 4 of the present invention. As shown in FIG. 3, the belt portion 4 has a weave structure such that a part, or the whole, of the wadding yarns 5 which had once been parallelly arranged inside the hollow woven structure 22 in the main body portion 2, are changed to be used as warp yarns 61 and thus the warp yarns 61 which had once been the wadding yarns 5, of the main body portion 2 cross the wefts with the warps 6 of the hollow woven structure of the main body portion 2, and has a width W of at least twice the width w of the main body portion 2. This change of the wadding yarns 5 to the warp yarns 61 is shown in FIG. 4, in that, for example, a group of warp yarns numerically shown as 3 or 5 at the top line of FIG. 4, each warp yarn first serving as a wadding yarn is changed to serve as a ground warp yarn of the weaving structure. The connecting portion 3 is constituted in such a manner as to shift step-wise to the woven structure of the main body portion 2 or of the belt portion 4 over a plurality of stages while its woven width is gradually changed.

In other words, the rope substitution belt according to the present invention, that is, the woven fabric shown in FIG. 1, is woven by a single shuttle loom or a single needle loom, but in both cases, a Dobby machine, a vertical mechanism of reeds and a mechanism for changing the number of picking of the wefts are necessary. In the case of the needle loom, a transverse movement mechanism of knitting needles operating in an interlocking arrangement with the change of the weave width is necessary in addition to the members described above. The mechanisms and the apparatuses described above are mounted on the loom and can be delivered integrally with the loom, on request to the manufacturer, and they are not novel mechanisms or apparatuses.

In the case of the shuttle loom, there are two kinds of moving systems for the shuttles, that is, a slide hook system and a rack and pinion system. When the warp total denier is greater than that of ordinary belts per unit dimension as in the present invention, it is preferred to use the rack and pinion system, or the slide hook system having a grooved slay described in Japanese Patent Application No. 4-272842.

Regarding a winding up roller or a pressing roller for the loom for making such a woven fabric as described in the figure, it is preferred to use the grooved roller described in Japanese Patent Application No. 4-272842.

Figure 2:
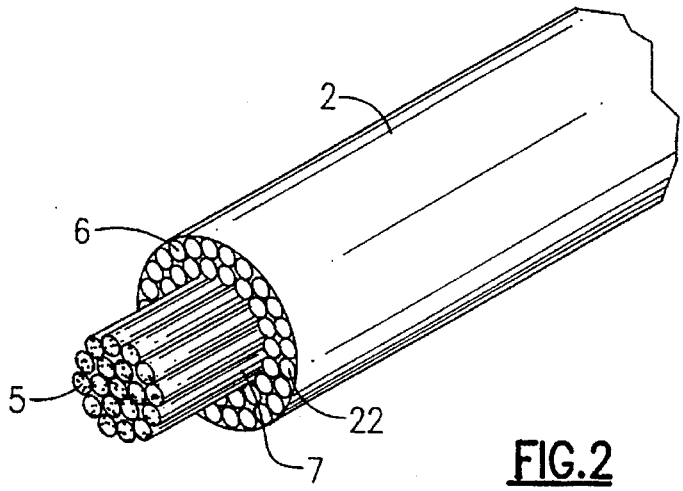
FIG. 2 is an enlarged view showing a structural example of a main body portion in the rope substitution belt according to the present invention.

FIG. 2 is a perspective view of the main body portion 2 which substitutes for the rope. The main body portion 2 comprises the hollow woven structure portion 22 woven into the hollow woven structure by a part of the warps 6 and the wefts 7, and a group of wadding yarns 5 solidly disposed inside the hollow woven portion 22.

A distribution ratio of the warps 6 distributed to the hollow woven structure portion and the warps used as the wadding yarns 5 among all the warps is an important factor for making the sectional shape of the main body portion after processing substantially round. Therefore, a concrete explanation will be given of this point. In this explanation, the meaning, and the method of determination, of the warp density coefficient defined by the present inventors as data necessary for the design of the woven fabric will be explained.

First, to determine the warp density coefficient in the present invention, it is necessary to stipulate the thickness of the yarns used for the woven fabric. The thickness of the yarns used in the present application is calculated by the following calculation formula.

$$0.0119\sqrt{(\text{denier number} \div \text{fiber density})} = \text{yarn diameter (mm)}$$

The thickness is calculated in the following way in the case of Nylon 1680D:

$$0.0119\sqrt{(1680 \div 1.14)} = 0.4568 \text{ (mm)}$$

The basis for the calculation of the warp density coefficient is the number of warps arranged theoretically in parallel between predetermined unit widths, and is expressed by parallel number=unit width÷yarn diameter.

This theoretical parallel number will be set to "warp density coefficient=1.000" in the present invention.

The practical warp density coefficient is calculated by using different calculation formulas depending on the weave structure.

Hereinafter, this calculation will be definitely explained for the cases of plain weave and 2/2 twill weave.

The plain weave has the structure wherein a half of the warps are woven each time from above to below between one weft and the next weft, while the other half are woven from below to above. Accordingly, since all the warps are aligned between the wefts, the warp density coefficient in the case of a 50 mm-wide woven fabric using Nylon 1680D as the warps is calculated as follows:

50 mm÷0.4568 mm=109.5 warp density coefficient=1,005 by 110 yarns

In the case of the 2/2 twill weave, one of a set of four yarns having a complete woven structure, rises, another yarn goes down, while the remaining two do not cross the wefts, when examined between the respective wefts in the same way as in the case of the plain weave. Accordingly, since only half of the yarns cross, the number of the warp yarns parallelly arranged to each other per unit width is doubled. In the case of a 50 mm wide-woven fabric using the warps of Nylon 1680D, for example, 50 mm÷0.4568 mm×2=218.9

Thus, the warp density coefficient is calculated as 1,000 by 219 warps.

In the case of multi-layered woven fabrics such as the plain weave and the 2/2 twill weave, calculation can be made for each layer in the same way as described above. Therefore, if two layers have the same woven structure and the same yarns, the parallel number of the warp yarns of the two layers becomes twice the parallel number of one layer per unit width by simple calculation. The reason why simple calculation is used is because connection yarns are woven in most cases into the multilayered woven fabrics, and the coefficient for the connection yarns, too, must be calculated from their texture and yarns, and must be incorporated. In most cases, the connection yarn has a small size and its number is small. Accordingly, the connection yarn does not cause a large fluctuation factor; hence, complicated explanations will be omitted. In addition in the main body portion as shown in FIG. 2, the wadding yarns are excluded in calculating the warp density coefficient because it does not cross the wefts.

In addition, calculations can also be performed using data obtained and built up over a long time by the inventors of the present invention by analyzing mass products, prototype products, etc., of the Applicant's company as well as products of other manufacturers and compiling the data. Namely, the following data calculated from the weight of the yarn, its yarn length extracted from the woven fabric etc., are used for the material of the product, the woven structure, the size, number and number of picking of the yarn used, the thickness and width of gray fabric and its set product, the object of use (e.g. ground yarn, selvage yarn, etc.), and so forth.

(1) sectional density coefficient (g/mm$^2$) =product weight (g)÷sectional area (mm$^2$)

(2) shrinkage ratio (thickness and width) of gray fabric when it is set, weight proportion, and change of apparent size (3) warp density coefficient and weft density coefficient (4) strength utilization ratio (%)=tensile strength÷(warp strength×number of warp)×100

The distribution and design of the hollow weave portion and the wadding portion of the main body portion are carried out in the following manner on the basis of the data described above in accordance with customers' requirements. Design must be made for the structures of the belt portion and the connection portion in consideration of their appearance, respectively.

(1) The total denier number of all the warps is calculated from the required strength in consideration of the strength utilization ratio.

(2) A final thickness of yarns provided in a completed product is estimated by calculating the diameter of a bundled yarn gathering the total denier number of all the warps.

(3) The outer peripheral length is calculated from the final thickness of the yarns or the thickness required by the customer estimated above.

(4) When the required strength is relatively low and the required thickness has priority over the required strength, other ground yarns or yarns different from the wadding yarn may be used so as to increase the volume. However, this yarn is preferably used as the wadding in the belt portion, too, in principle.

(5) When stiffness is required or in other cases, monofilaments may be added as a core yarn or a wadding yarn for the same reason as the item (4) described above. However, this yarn should be preferably used as the wadding yarn even in the belt portion, too. Monofilaments are preferably used in combination in the fields of application where the fabric is immersed in water and must be then dried quickly.

(6) The woven structure of the hollow weave portion and the size of the yarns used are decided.

(7) The number of yarns is provisionally determined by estimating the warp density coefficient for the outer peripheral length decided in the item (3) from the woven structure and the yarn size obtained in the item (6). Unless the warp density coefficient is set to be not greater than 0.700, shrinkage in the widthwise direction will be insufficient during post-treatment for finishing the product, and the wadding yarns will have a large number of voids.

(8) The yarn diameter of all the wadding yarns is calculated from the total denier number of the wadding yarns except for the warps consisting of the hollow woven structure, which are a part of the whole warps. When the required thickness has priority, the yarn diameter is determined by inverse calculation from the total denier number of the wadding yarns.

(9) The outer peripheral length of the hollow woven structure is again calculated by estimating the expansion of the wadding yarns due to post-treatment.

(10) The data of the warp yarn density, the material, the woven structure and the size of the warp yarn that are calculated, and the data of the material of weft yarn to be used, the size thereof, the number of picking, etc., are compared with the previously accumulated data, and the thickness of the hollow woven structure portion and the shrinkage ratio of the wefts are estimated. Whether or not they are suitable as the hollow woven structure for wrapping the wadding yarns is judged, and if they are not, correction is made by calculating again.

As to the warp proportion between the warp yarns forming the hollow woven structure and those forming the wadding yarn portion of the main body portion, the proportion of the wadding yarns becomes greater when the thickness of the final product is greater, but in the hollow woven structure, the total denier number of the wadding yarn should be at least 1.5 times as large as the total denier number of the warp yarns forming the hollow woven structure.

Japanese Examined Utility Model Publication (Kokoku) No. 62-14137 mentioned in the "Prior Art" does not disclose the various necessary conditions described above. The reason why the present inventors describe "A circular woven structure portion has a rope-like shape, its inside is solid, and its section is round", is improbable judging from the necessary conditions described above.

FIG. 3 is a sectional view of the belt portion 4. As is obvious from FIG. 3, the belt portion 4 of the rope substitution belt 1 has a sectional structure wherein the warps 61 and the wefts 71 constitute the hollow woven structure portion, and a predetermined number of wadding yarns 5 are disposed inside the hollow woven structure.

Reference numeral 51 in the drawing denotes connecting yarns or stitching yarns, that connect the woven structure portions on the front and back constituting the hollow woven structure portion.

When the woven fabric is used as the product, the belt portion is ordinarily sewn to itself by folding the belt portion over to form a loop, as is known in the art. From the aspects of sewing process and sewing strength, the thickness and width of the sewn surface must be appropriate, and if the number of points of intersection of the warps and the wefts is small, the sewing strength becomes insufficient.

When the total denier number of the wadding yarns 5 is similar to the total denier number of the warp yarns 6 of he hollow woven structure portion 22 of the main body of the belt portion 4, in the belt portion 4, about a half of the ground yarns consists of the warp yarns forming the hollow woven structure 22 of the main body portion 2, while the other half consists of the warps forming the wadding yarns 5 at the main body portion 2. The remaining yarns of the wadding yarns 5 of the main body portion 2 are woven into the belt portion 4 as the wadding yarns 5, or are used for connecting yarns in the belt portion 4.

When the proportion of the wadding yarns 5 of the main body portion 2 is large, it is preferable that about one-third of the ground warps of the belt portion 4 consists of the warp yarns 6 forming the hollow woven structure portion 22 of the main body portion 2, while the remaining two-thirds consists of the warp yarns 5 forming the wadding yarns 5, in the main body portion 2.

Figure 4B:
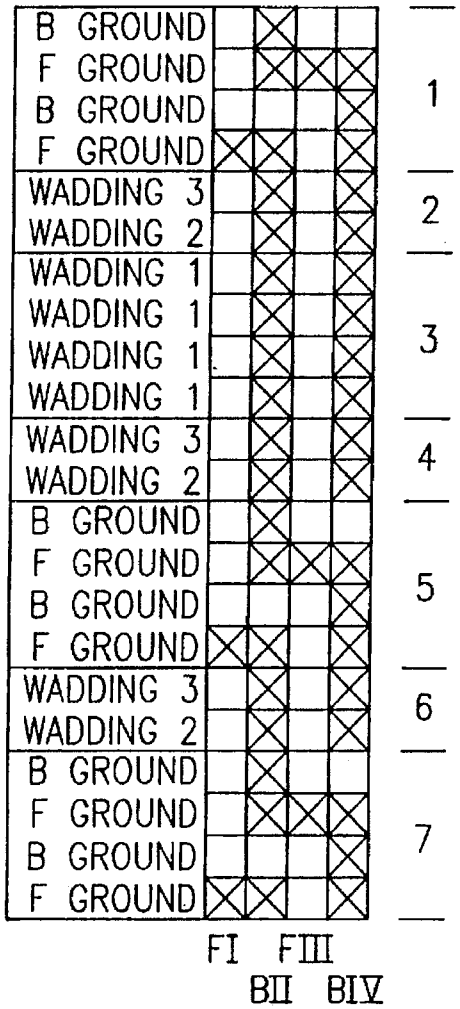
FIG. 4(B) shows the second step in changing fabric construction of a connecting portion in one embodiment of the rope substitution belt of the present invention.
Figure 8A:
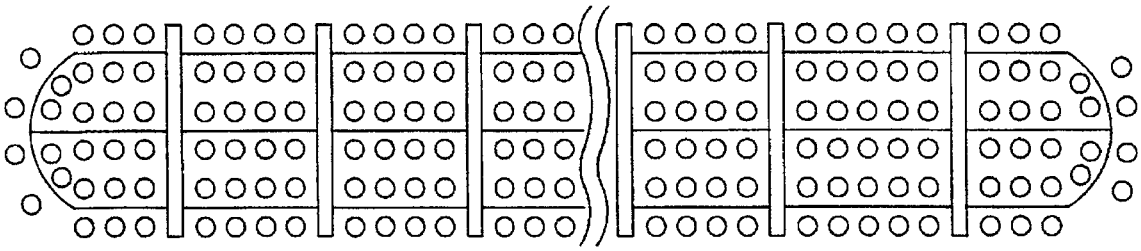
FIG. 8*a* is an enlarged view showing a structural example of a triple woven structure.
Figure 8B:
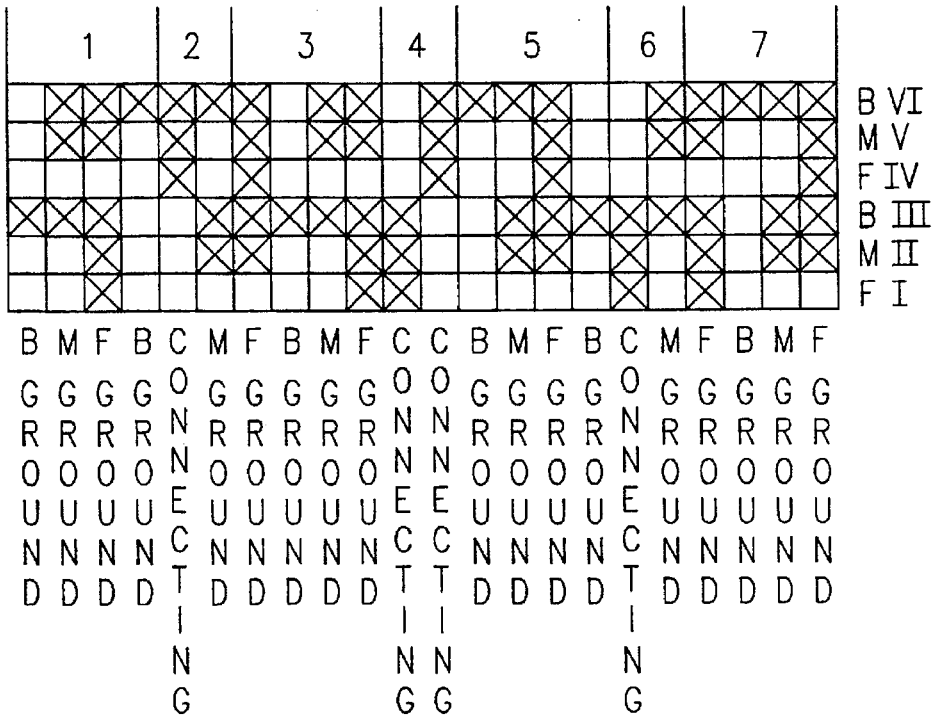
FIG. 8*b* is a basic structural view useful for explaining an example of the woven structure of FIG. 8*a*.

Clearly, the proportion of the wadding yarns 5 to be woven so as to be arranged on the surface of the belt is not limited to the proportion described above, and it can be changed in accordance with the woven structure and external appearance thereof. In both cases, double weave construction is preferable when the wadding yarns are incorporated in the woven structure, but triple weave structure may also be used. When it is necessary to particularly increase the width of the belt portion 4, double weave structure may further be changed to single weave structure. One typical single weave construction and one typical triple weave construction which can be used in the present invention are shown in FIGS. 7*a–b* and FIGS. 8*a–b*, respectively. FIGS. 7*a–b* and 8*a–b*, shows the woven construction used in the bolt portion as shown in the stages of FIGS. 4(D) and 4(E), respectively. In FIG. 8(*b*), M denotes middle ground warp yarn as used for forming a middle woven portion of the triple woven construction which is formed between a front woven portion and a back woven portion thereof.

The fabric construction described above is used in order to provide the belt portion 4 with the flat shape and with the sectional shape suitable for sewing. In other words, when a part of the wadding yarns 5 are woven so as to be arranged on the surface of the belt portion 4 in the main body portion 2, the number of the surface warp yarns becomes relatively large and the width of the belt must be increased. Accordingly, the belt portion 4 becomes flat and comes to have a sectional shape suitable for sewing. In order to make the thickness and width of the belt portion 4 suitable for sewing, the width thereof must be at least twice the width (that is, diameter) of the main body portion 2.

FIG. 4 is a structural view showing the connecting portions 3 between the main body portion 2 and the belt portion 4.

At the first stage of the shift of the main body portion 2 to the belt portion 4, the width of the reed is gradually increased while maintaining the woven structure of the main body portion 2, and then the wadding yarns 5 are woven so as to be arranged on the surface of the belt at the second stage. For example, when the woven structure of the hollow weave portion 22 is a 1/1 plain weave, two wadding yarns 5 are regularly woven so as to be arranged on the surface of the belt through a gap formed between a pair of two warps 6 forming the hollow woven structure and another adjacent pair of two warps 6, and in this way, the appearance of the boundary formed between this connecting portion 3 and the hollow weave portion 22 does not deteriorate significantly.

At the third stage, the width of the belt is gradually increased, and when it is close to a set width, the remaining part of the wadding yarns is woven as the connecting yarn and in this way, the width thereof can be easily increased. When the number of waddings is large, and when they are woven into the belt as the ground yarns of the belt portion, they may be woven in two steps by disposing another stage between the second and third stages. In such a case, the third stage described above becomes the fourth stage.

All of the stages described above are necessary in some cases, but one or two of them, such as the first and fourth stages, may be omitted. However, unless the weaving operation is carried out in at least two stages, there will be a portion at which the change of the width and thickness of the connecting portion become extreme, which is undesirable. Generally, the change of the number of picking of the weft yarns is made simultaneously with the change of the width of the connecting portion.

FIGS. 4(A) to 4(E) are structural views of the connection portion 3 at the respective stages explained above.

The explanation given above deals with the shift from the main body portion 2 to the belt portion 4, and the shift from the belt portion 4 to the main body portion 2 is effected by reversing the steps described above.

Another important point to address is how the connecting portion 3 is woven. The afore-mentioned prior art reference Japanese Examined Utility Model Publication (Kokoku) No. 62-14137 does not describe connection means between the flat weave texture portion and the circular weave texture portion.

Here, the woven structure of the connecting portion 3 in the rope substitution belt according to the present invention will be explained in detail with reference to FIGS. 4(A) to 4(E).

Figure 4A:
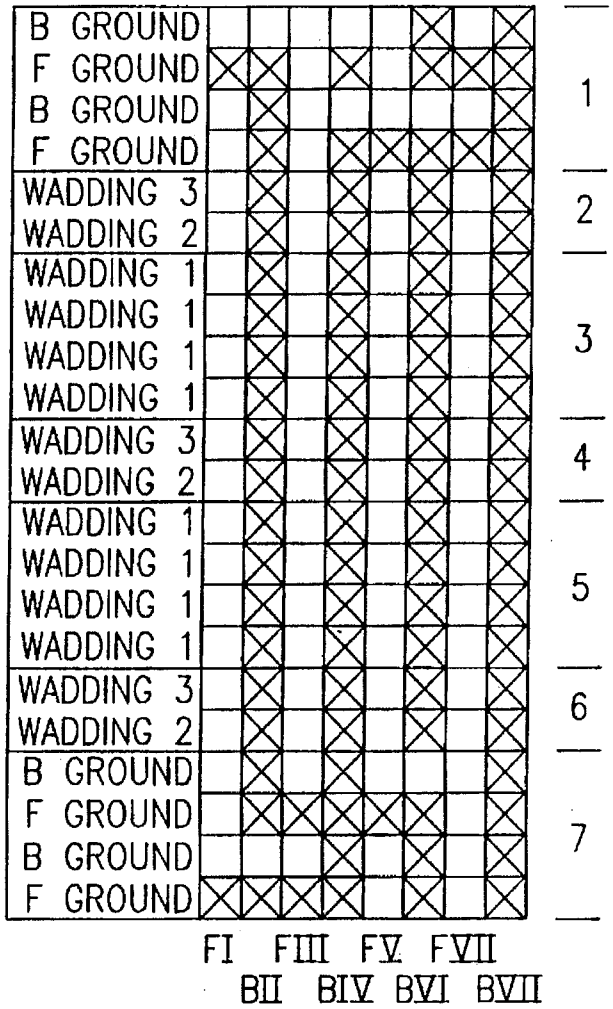
FIG. 4(A) shows the first step in changing fabric construction of a connecting portion in one embodiment of the rope substitution belt.

FIG. 4(A) is a diagram of a woven structure showing an example of the woven structure of the main body portion 2 in the rope substitution belt 1, according to the present invention.

A portion A-1 and a portion A-7 in the woven structure of FIG. 4(A) represent the woven structure constituting the hollow woven structure portion 22 of the main body portion 2. A front warp ground yarn F, a back warp ground yarn B, weft yarns FI, FIII, FV, FVII and back weft yarns BII, BIV, BVI, BVIII constitute the hollow woven structure of a 2/2 twill weave. Each of the wadding yarn 1 to 3 of each of the A-2 portion, the A-3 portion, the A-4 portion, the A-5 portion and the A-6 portion, is packed inside this hollow woven structure portion, and a rope-like structure having a round sectional shape can be obtained.

Next, the structure of the connecting portion 3 connected to the main body portion 2 will be explained with reference to FIGS. 4(B) to 4(D). In the rope substitution belt 1 according to the present invention, a woven structure having a substantially circular sectional shape must be changed to a woven structure having a flat sectional shape during the process of the change from the main body portion 2 to the belt portion 4 or vice versa, and such a change is preferably step-wise and gradual.

Accordingly, in a definite example of the rope substitution belt 1 according to the present invention, the change of the woven structure of the connection portion 3 is carried out in three stages as shown in FIG. 1 in such a manner as to gradually change the section of the woven structure.

In other words, FIG. 4(B) shows the woven structure of the connection portion 3-1 directly connected to the main body portion 2 at the first stage, and the B-1 portion and the B-7 portion represent the woven structure constituting the hollow woven structure portion of the 1/1 plain weave. The front warp ground yarn F, the back warp ground yarn B, the front wefts FI, FIII and the back wefts BII, BIV constitute the hollow woven structure consisting of the 1/1 plain weave, and among the wadding yarns 1 to 3 of the A-2 portions, A-3 portion, A-4 portion, A-5 portion and A-6 portion, a part of the wadding yarns denoted as the A-5 portion are exposed to the hollow woven structure portion and are used for warp yarns in weaving this hollow woven structure portion.

In this embodiment, therefore, the wadding yarns 1 disposed in the A-5 portion are divided into two groups, part of them are used as the front warp ground yarn F, while the rest are used as the back warp ground yarn B.

As a result, the width of the woven connection portion 3-1 is likely to increase because the wadding yarns 1 disposed in the A-5 portion are added to the hollow woven structure.

Next, the connection portion 3-2 connecting to the connection portion 3-1 in this connecting portion 3 is woven. As shown in FIG. 4(C) as the woven structure of this connecting portion 3-2, the wadding yarns 1 disposed at this B-3 portion are divided into two groups in the same way as in FIG. 4(B), a part of them is used as the front warp ground yarn F while the rest are used as the back warp ground yarn B so that the wadding yarns 1 are exposed on a surface of the hollow woven structure portion and are caused to be involved in weaving of this hollow woven structure.

As a result, the width of this connecting portion 3-2 is likely to increase because the wadding yarns 1 disposed in this B-3 portion are added to the hollow woven structure.

Thereafter, the connecting portion 3-3 for directly connecting the connection portion 3 to the belt portion 4 is woven in succession with the connection portion 3-2.

As shown in FIG. 4(D), a diagram of the woven structure of this connection portion 3-3, among the wadding yarns 2, 3 of the C-2 portion, the C-4 portion and the C-6 portion, a part of the wadding yarns 3 is used as the connecting yarns in this hollow woven structure portion, so that the surface portion of the hollow woven structure portion at this connection portion 3-3 is firmly bonded to the back texture portion, and the flat shape is fixedly formed.

Moreover, the width of this woven connection portion 3-2 is finally increased to a weave width which is in agreement with the weave width of the predetermined belt portion 4 at this stage, and the connecting portion 3-2 can be as such connected to the woven structure of the belt portion 4.

FIG. 4(E) shows the woven structure of the belt portion 4 of the rope substitution belt 1 according to the present invention, and it has the same woven structure as the woven structure of the connection portion 3-3 as shown in FIG. 4(D).

Next, heat-set processing after weaving will be explained.

The term "heat-set processing" used in this invention represents heat-treatment which processes a woven fabric using hot air, which is generally practiced as a finish processing.

In the present invention, particularly in the main body portion 2, shrinkage of the weft yarn is an important factor. The main body portion immediately after weaving is woven into an elliptic sectional shape, and the wefts undergo shrinkage at the time of heat-set processing and the section becomes substantially circular. JIS L1013, "Test Method of Chemical Fiber Filament Yarns", 7.15, stipulates a hot water shrinkage ratio measurement method and a dry heat shrinkage ratio measurement method, and test results based on these methods are reported by each manufacturer of raw yarns. Among fibers of the same kind, yarns of the type having a greater shrinkage ratio test result are preferably used as the wefts.

Even if wefts of the same type having a large shrinkage ratio are used, the shrinkage ratio of the woven fabric in the transverse direction differs depending on the warp density coefficient explained in the present invention. However, according to the data compiled by the inventors of the present invention, it is possible to estimate how much shrinkage the woven structure undergoes, and a weave structure having a large shrinkage can be easily obtained by using this data.

Even when weft yarn having a large shrinkage ratio is used, shrinkage at the belt portion remains only slight because the warp yarn density coefficient is great. When heat-set is carried out in a substantially tension-free state, the main body portion develops a substantially circular sectional shape having a hardness which does not cause any practical problems.

When necessary, the hardness of the main body portion can be increased by immersing the woven structure in a synthetic resin solution at the time of the ordinary heat-set processing or before a next mold heat-treatment processing. The synthetic resin used is selected from urethane, melamine, vinyl acrylacetate, and so forth.

Next, the mold heat-treatment method newly employed in the present invention will be explained.

When it is desired in the present invention to increase not only the hardness in feeling but also the packing density of the main body portion 2, these objects can be accomplished by preparing a pair of press molds having a semicircular groove having a predetermined dimension, heating the molds, and clamping and pressing the main body portion 2 after heat-set or after the resin processing between the groove portions. This kind of machining method is referred to as the "mold heat-treatment" in the present invention.

An example of this processing apparatus will be explained in further detail. Each mold incorporates therein a heater so the temperature can be controlled. One of the molds is fixed to the apparatus main body, and the other is fitted to an apparatus which imparts a pressure to the other mold while moving. A pressure gauge is accessorily fitted to the apparatus, and a timer is built in so that the pressure application time, too, can be set.

The molds are designed so that they can be changed in accordance with the size and the shape of the product to be processed. The processing conditions are set in accordance with the material of the processed product, the thickness of the product, the type of the raw yarn, the warp density coefficients, etc., which are used to set the mold temperature, the pressing force, the pressure duration time, and so forth. The product resulting from the mold heat-treatment processing carried out in this way has a perfect circular section, a high packing density, and a flat and attractive surface appearance in comparison with the ordinary heat-set products.

Besides the means described above, another means of the mold heat-treatment uses a pair of molds wherein the circle at the inlet of each mold is enlarged and is progressively reduced towards the outlet so that the product is heat-treated while being passed through the grooves.

Though the above explanation was given for the case where the finished section of the product is round, the section may be other shapes, such as an ellipse.

The processing method by the resin processing and the mold heat-treatment exhibits its effects for not only the main body portion 2 according to the present invention but also for the rope substitution belt in "Thick Belt and Its Production Method" described in Japanese Patent Application No. 4-272842.

Hereinafter, definite examples of the rope substitution belt 1 according to the present invention will be explained.

EXAMPLE 1

The target strength of the rope substitution belt in this example was at least 4,100 kgf, and the diameter of the main body portion was 10 mm.

Structure of the main body portion 2 of the belt having a relatively circular configuration as shown in FIGS. 1 and 2:

| Weaving texture: 2/2 twill double weave | | | |
|---|---|---|---|
| ground yarn | nylon | 2 plied yarn of 1,680 d/2 | 28 yarns |
| wadding 1 | nylon | 2 plied yarn of 1,680 d/2 | 48 yarns |
| wadding 2 | nylon | 1,680 d/2 | 19 yarns |
| wadding 3 | nylon | 1,680 d/1 | 18 yarns |
| weft | polyester | 1,000 d/1 | 34 pick/3 cm |
| doup yarn | polyester | 1,000 d/1 | 1 yarn |
| total denier number of ground yarns | | 188,160 d | |
| total denier number of wadding yarns | | 416,640 d (2.2 times that of the base yarns) | |

Polyester was used for the weft yarns and doup yarn because a yarn type whose dry heat shrinkage ratio was previously determined was selected so as to conduct the heat-set processing by dry heat-treatment. According to the report from a manufacturer, the yarns used had a shrinkage ratio of 14.5% at 150° C. for 30 min.

A needle loom was used as the loom, and the gray fabric thus obtained from the yarn structure described above had the following specification.

(1) The section was elliptic, the thickness at the center was 7.2 mm, the width was 16.8 mm and the outer peripheral length was 40 mm.

(2) The warp density coefficient of the ground yarns was 0.538.

First stage in the connecting portion:

As shown in FIG. 4(B), the woven structure was the 1/1 hollow weave.

First, while the width of the reed was expanded, the front and back ground yarns constituting the main body portion 2 were woven to form a front and a back surface of the belt, respectively.

A half of the total number of wadding yarns 1, i.e., 24 yarns are also woven into a front and a back surfaces of the fabric, by arranging group of two wadding yarns between two adjacent front yarn groups or back yarn groups, where each group consists of two yarns.

The number of picking of the wefts was gradually decreased.

Figure 4C:
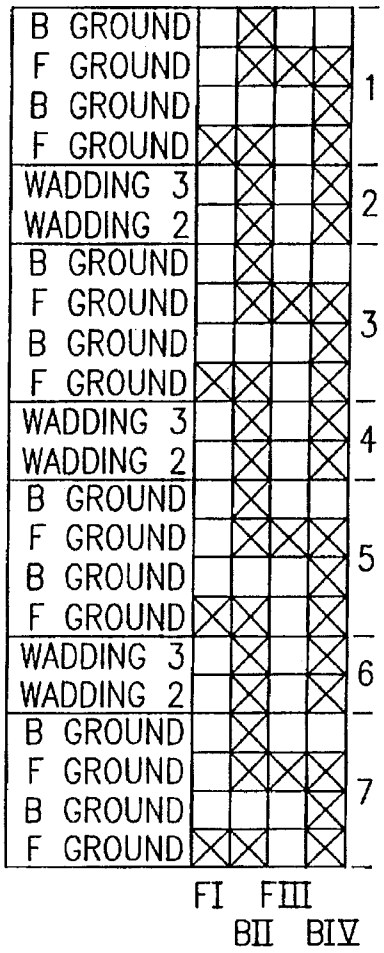
FIG. 4(C) shows the third step in changing fabric construction of a connecting portion in one embodiment of the rope substitution belt of the present invention. according to the present invention.
Figure 4D:
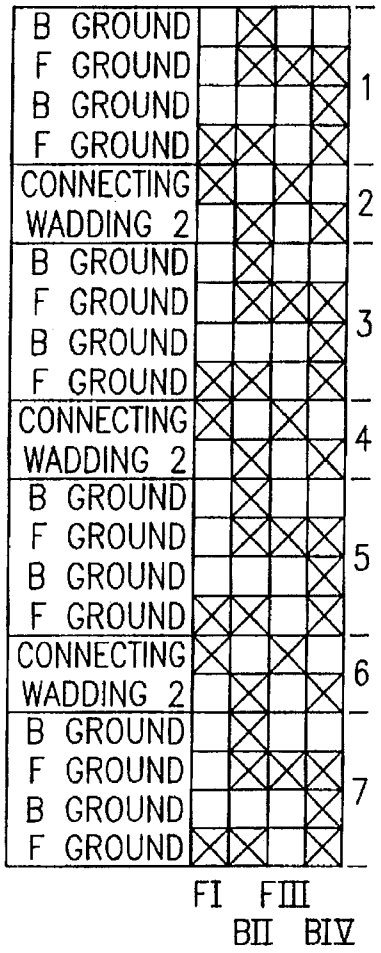
Figure 4E:
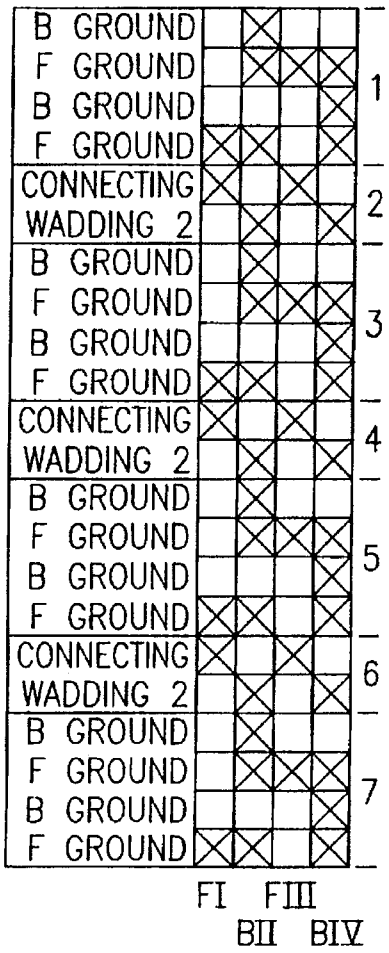

Second stage in the connecting portion:

As shown in FIG. 4(C), the remaining half of the waddings 1, that is, 24 waddings, were similarly woven so as to be arranged on both surfaces of the belt like fabric. In the interim, the width of the reed was expanded, and the number of picking of the wefts was also reduced gradually.

Connection portion, third stage:

As shown in FIG. 4(D), the wadding yarns 3 were used as the connecting yarns so as to connect both front and back surfaces. The waddings 2 hereby remained as the waddings. The width of the reed was still being expanded, and the number of picking was still decreased, as well.

Structure of the belt portion:

| weaving texture: 1/1 plain double weave | | | |
|---|---|---|---|
| ground yarn | nylon | 2 plied yarn of 1,680 d/2 | 76 yarns |
| wadding | nylon | 1,680 d/2 | 19 yarns |
| connecting yarns | nylon | 1,680 d/1 | 18 yarns |
| weft | polyester | 1,000 d/1 | 19.5 pick/3 cm |
| doup yarn | polyester | 1,000 d/1 | 1 yarn |

-continued

| weaving texture: 1/1 plain double weave | |
|---|---|
| total denier number of ground yarns | 510,720 d |
| total denier number of wadding yarns | 63,840 d |

The gray yarn obtained by shifting the yarn structure to the structure described above at the connection portion third stage had the following specification.

(1) The section was square, the thickness was 2.9 mm, and the width was 48.4 mm.

(2) The warp density coefficient of the ground yarn and the connecting yarn was 1.099.

(3) The weight was 82.4 g/m.

Next, weaving proceeded to the main body portion through the opposite process, that is, the connection portion third stage, the second stage and the first stage.

The woven fabric was obtained by repeating the steps described above.

The product obtained by conducting the heat-set processing after weaving had the following specification and properties.

(1) The section of the main body portion was substantially circular and the diameter was 11.5 mm. Though the main body portion was somewhat softer than rope, this softness did not give rise to any practical problems.

(2) The belt portion had a thickness of 2.7 mm, and its width changed to 46.4 mm.

(3) The tensile strength was 4,435 kgf.

The heat-set processing and the resin processing were carried out under the following condition.

(1) The gray fabric was immersed in a solution of 250 g/l of a urethane resin, and the solution contained inside the fabric was squeezed.

(2) After drying was carried out at 120° C. /5 minutes, curing was done at 160° C. for 3 minutes.

Due to the effect of the resin, the product had a hardness substantially equal to that of rope.

After the resin processing, the product was subjected to mold heat-treatment processing under the following conditions.

(1) The mold used included a pair of upper and lower molds having a semicircular groove having a diameter of 10 mm.

(2) The mold temperature was set to 160° C.

(3) The mold pressure was set to 70 kgf.

(4) The pressure duration was set to 40 seconds.

The main body portion of the product after this mold heat-treatment had a circular section having a diameter of 10 mm, and the shape did not change when the product was gripped by hand.

EXAMPLE 2

The target diameter of the main body portion was 12 mm, and polypropylene yarns (thickener) were used for a part of the wadding yarns.

Structure of the main body portion:

| weaving texture: 2/2 twill double weave | | | |
|---|---|---|---|
| ground yarns | nylon | two-plied yarn of 1,680 d/2 | 36 yarns |
| wadding 1 | nylon | two-plied yarn of 1,680 d/2 | 64 yarns |
| wadding 2 | polypropylene | 680 d/2 | 92 yarns (125,120 d) |

-continued

| weaving texture: 2/2 twill double weave | | | |
|---|---|---|---|
| wadding 3 | nylon | 1,680 d/1 | 24 yarns |
| weft | polyester | 1,000 d/1 | 34 pick/3 cm |
| doup yarn | polyester | 1,000 d/1 | 1 yarn |
| total denier number of ground yarns | | 241,920 d | |
| total denier number of waddings | | 595,520 d (2.5 times that of the ground yarns) | |

The polypropylene yarns were used for the wadding yarns in order to increase the volume (Equivalent to 156,700 d of nylon yarns).

Using polyester for the wefts and the doup yarns was because a yarn type whose dry heat shrinkage ratio was previously determined was selected so as to conduct the heat-set processing by dry heat-treatment, and the yarns having a shrinkage ratio of 14.5% at 150° C. for 30 minutes, according to the report of the manufacturer were used.

A needle loom was used for the loom, and the grey fabric woven by the yarn structure described above had the following specification.

(1) The section was elliptic, the thickness at the center was 7.5 mm, the width was 17.4 mm, and the outer peripheral length was 42 mm.

(2) The warp yarn density coefficient of the ground yarns was 0.559.

First stage in the connecting portion:

As shown in FIG. 4(B), the woven structure was 1/1 hollow weave. First, while the width of the reed was expanded, the front and back ground yarns constituting the main body portion 2 were woven to form a front and a back surface of the belt, respectively. Half of the total number of wadding yarns 1, i.e., 32 yarns, is also woven into the front and the back surface, by arranging group of two wadding yarns between two adjacent front yarn groups or back yarn groups, where each group consists of two yarns. The number of picking of the weft yarns was gradually decreased during weaving.

Second stage in the connecting portion:

As shown in FIG. 4(C), the remaining half of the wadding yarns 1, i.e. 32 yarns, are also similarly woven as mentioned above so that the rest of 32 wadding yarns are woven into a fabric to form both surfaces of the belt. In the interim, too, the width of the reed was expanded, and the number of picking of the weft yarns, too, was gradually decreased.

Third stage in the connecting portion:

As shown in FIG. 4(D), both the front and the back surface were connected by using the wadding yarns 3 as the connecting yarns. The wadding yarns 2 remained hereby as the wadding yarns. The width of the reed continued to expand, and the number of picking, too, continued to decrease.

Structure of belt portion:

| weaving texture: 1/1 plain double weave | | | |
|---|---|---|---|
| ground yarns | nylon | two plied yarn of 1,680 d/2 | 100 yarns |
| wadding yarn | polypropylene | 680 d/2 | 92 yarns |
| connecting yarn | nylon | 1,680 d/1 | 24 yarns |
| weft | polyester | 1,000 d/1 | 19.5 pick/3 cm |
| doup yarn | polyester | 1,000 d/1 | yarn//1 yarn |

-continued

| weaving texture: 1/1 plain double weave | |
|---|---|
| total denier number of ground yarns | 672,000 d |
| total denier number of wadding yarns | 125,120 d |

In the third stage, the construction of the connecting portion had shifted to the woven structure described above, and the gray fabric thus woven had the following specification.

(1) The section was square, the thickness of 2.9 mm, and the width was 60.0 mm.

(2) The warp density coefficients of the ground yarns and the connecting yarns were both 1.168.

(3) The weight was 115.6 g/m.

Next, woven structure of the connecting portion was shifted to the main body portion by reversing the processes of the third, second and first stages of the above-mentioned process.

Weaving was carried out by repeating each of the steps described above.

The product which was heat-set after weaving had the following specification and properties.

(1) The section of the main body portion was substantially circular and its diameter was 13.2 mm. Though the product was somewhat softer than the rope, this softness did not give rise to any practical problems.

(2) The belt portion was 2.7 mm thick, and the width changed to 57.5 mm.

(3) The tensile strength was 5,500 kgf.

The heat-set processing and the resin processing were carried out under the following conditions.

(1) The gray fabric was immersed in a solution of a urethane resin 250 g/l, and the solution contained in the fabric was squeezed.

(2) After the fabric was dried at 120° C. for 5 minutes, it was cured at 160° C. for 3 minutes.

Due to the effect of the resin, the fabric showed hardness substantially equal to that of rope.

The mold heat-treatment processing was carried out for the product after the resin processing under the following conditions.

(1) The mold used consisted of a pair of upper and lower molds having a semicircular groove having a diameter of 12 mm.

(2) The mold temperature was set to 160° C.

(3) The mold pressure was set to 70 kgf.

(4) The pressure was set to apply for 40 seconds.

The main body portion 2 of the product after the mold heat-treatment processing had a round section of a diameter of 12 mm, and the shape did not change when the product was gripped by hand.

COMPARATIVE EXAMPLE

Figure 5A:
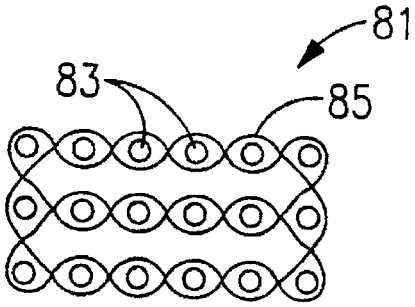
FIG. 5(A) is a view showing a flat woven structure portion of "a main body portion and a belt portion" in a prior art example.
Figure 5B:
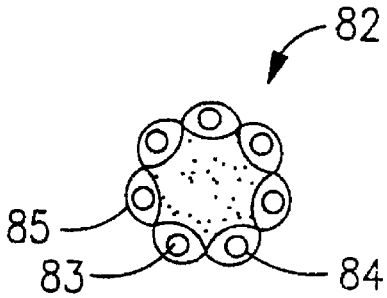
FIG. 5(B) is a view showing a sectional structure of a circular woven structure portion.
Figure 6:
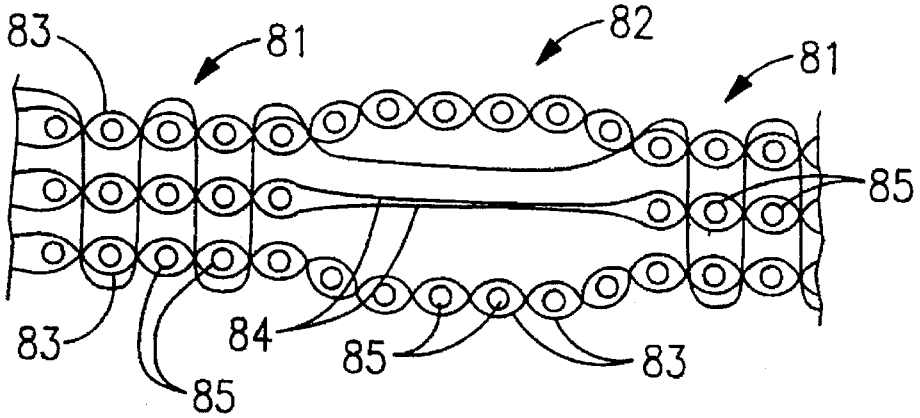
FIG. 6 is a side view useful for explaining an example of a triple weave structure in a prior art example.
Figure 7A:
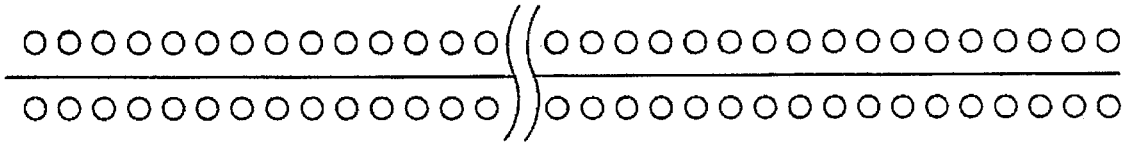
FIG. 7*a* is an enlarged view showing a structural example of a single woven structure.
Figure 7B:
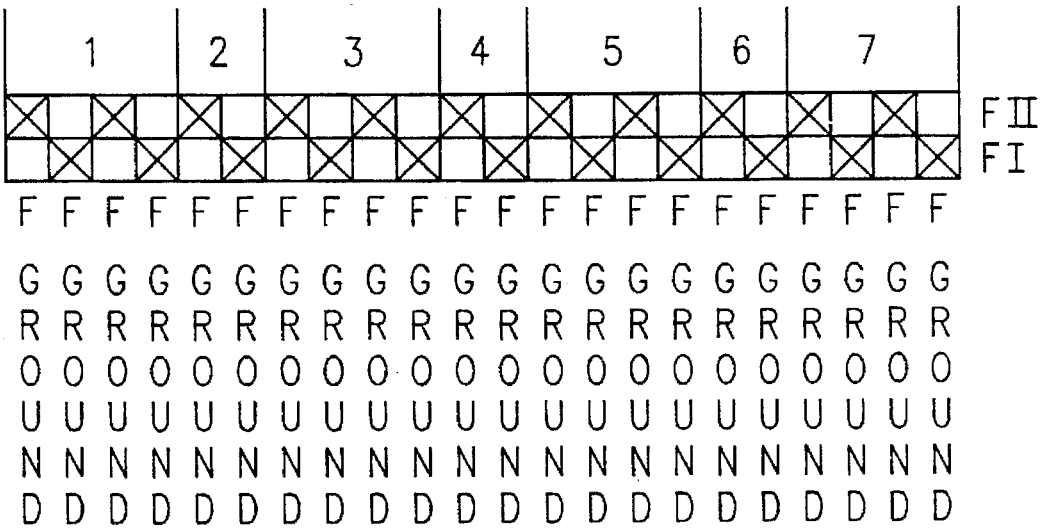
FIG. 7*b* is a basic structural view for explaining an example of the woven structure of FIG. 7*a*.

FIGS. 9 and 10 of Japanese Examined Utility Model Publication (Kokoku) No. 62-14137, mentioned in the "Prior Art" and shown in FIGS. 5 and 6, clearly show a ratio of the hollow woven portion to the wadding portion in the fabric. Therefore, this prior art technology will be reproduced with the highest fidelity possible by one skilled in the art.

Structure of belt portion:

| weaving texture: 1/1 plain triple weave (structure based on FIG. 5) | | | |
|---|---|---|---|
| ground warp yarn | nylon | 1,680 d/2 | 97 yarns |
| connecting yarn | nylon | 1,680 d/1 | 15 yarns |
| weft | nylon | 840 d/1 | 36 pick/3 cm |
| doup yarn | nylon | 840 d/1 | 1 yarn |

The width of the belt was set to 30 mm after finishing and produced by a needle loom with the yarn specification described above. Therefore, it is an extremely ordinary specification of a narrow width woven fabric. Since triple weave was employed, one layer consists of 32 warp yarns, and only one layer consists of 33 warp yarns in connection with the relation of the selvage yarns. Generally, the connecting yarn was made thinner than the ground yarn to prevent it from being seen from the surface. A woven fabric according to this specification could be woven without any problems.

Structure of circular weave portion:

| weaving texture: 1/1 plain double weave (structure based on FIG. 6) | | | |
|---|---|---|---|
| ground yarn | nylon | 1,680 d/2 | 65 yarns |
| wadding yarn | nylon | 1,680 d/2 | 32 yarns |
| (yarn for second layer of belt portion) | | | |
| wadding yarn | nylon | 1,680 d/1 | 15 yarns |
| (connection yarn for belt portion) | | | |
| weft | nylon | 840 d/1 | 24 pick/3 cm |
| doup yarn | nylon | 840 d/1 | 1 yarn |

The total denier number of the ground yarns was 218,400 d, the total denier number of the wadding yarns was 132,720 d, and the proportion of the wadding yarns to the ground yarns was 60.8/100. The diameter of the nylon 1,680/2 was 0.6460 mm, and the parallel width of 65 ground yarns was calculated as 42 mm.

Accordingly, even when the warp density coefficient was set to 1,000 in the 1/1 plain double weave, the outer circumference of the circular weave portion was 42 mm is length and was 13.4 mm in outer diameter. Since the thickness of the outer peripheral circular weave portion was estimated to be about 1.2 mm, the inner diameter of the circular weave was calculated as about 11.0 mm. On the other hand, when the diameter of the wadding yarns was calculated in accordance with the calculation formula of the present invention, it was only 4.06 mm.

Therefore, there was a big difference between the above-mentioned figure and the desired number of wadding yarns of the circular weave, and the section obviously did not become circular.

When the outer circumference of the wadding yarns in this specification was inversely calculated in order to wrap then by the circular weave, the sectional diameter and the outer circumference had to be 7.1 mm and 22.3 mm, respectively, when the diameter of the wadding yarns was 4.1 mm and the thickness of the outer peripheral circular weave portion was about 1.5 mm. In other words, the parallel width of the warp yarns, which is 42 mm had to be set in the woven structure at a width of 22.3 mm. When the warp density coefficient at this time was calculated, it was given by (yarn diameter 0.6460 mm×65 yarns)÷22.3=1.883, and this density coefficient could not be established in woven fabrics according to the experience and observations of those skilled in the art.

The rope substitution belt according to the present invention has a main body portion, the solid section of which is circular or substantially circular, which could hitherto not be made by narrow width woven fabrics, and since the belt portions exist at both ends of the main body portion, the present invention does not require the so-called "Satsuma" processing that has been inevitably employed, but can be connected by simple sewing means. The structure of the present invention has not been substantially available in the past, and the product of the present invention can be used as a rope substitution belt for a safety belt for work on poles, a sling part of a flexible container, a sling belt and other novel applications.

The rope substitution belt after the mold heat-treatment processing has further stabilized shape and size, excellent appearance and improved commercial value.

The main body portion of Example 1 of the present invention has 82.2 g/m. When this value is compared with the standard of nylon ropes of JIS L2704, it corresponds to a diameter of 11.5 mm from the line density, and a strength of at least 2,600 kgf is required. In contrast, when the strength of the main body portion inclusive of the belt portion is measured, the result is 4,435 kgf.

The value is 166.7% greater than the JIS standard, a drastic improvement. Compared to rope, the strength utilization ratio is by far higher, and an equivalent strength can be produced at a lower production cost. Further, the weight necessary to obtain equivalent strength may be only about 60% (2,600 kgs) according to the structure of the present invention, and even when the strength is set to 70% (3,030 kgf) so as to improve safety, the desired reduction in the weight of the belt (for example, a reduction of –24 g/m) can be accomplished.

When a higher priority is placed on the required thickness as in Example 2 of the present invention, this can be accomplished by using a fiber having a low specific gravity as the wadding yarns throughout the main body portion, the connection portion and the belt portion, and this, too, greatly contributes to the reduction of the cost and the weight.

What is claimed is:

1. A rope substitution belt having a main body portion, a belt portion and a connecting portion for connecting said main body portion to said belt portion, each portion being disposed in a predetermined length in a longitudinal direction of said belt, as a narrow width woven fabric having warp yarns and weft yarns of synthetic fiber filaments, wherein said main body portion has wadding yarns that are woven into a hollow woven structure so that said wadding yarns are parallelly arranged to each other inside said woven structure and are tightly surrounded by said woven structure, a total denier number of said wadding yarns is at least 1.5 times a total denier number of warp yarns of said hollow woven structure, said hollow woven structure has a warp density coefficient of not greater than 0.700, said belt portion has a woven structure in which warp yarns which once had been used as at least part of the wadding yarns of said main body portion are so arranged as to cross said weft yarns with said warp yarns of said hollow woven structure portion of said main body portion, said belt portion has a width of at least 2.0 times a width of said main body portion, and in said connecting portion a width of a woven structure thereof is gradually changed, the woven structure of said connecting portion shifting step-wise over a plurality of stages, from a woven structure of said main body portion to a woven structure of said belt portion.

2. A rope substitution belt according to claim 1, wherein at least said main body portion had been subjected to a thermal treatment so that the yarns used in said main body portion have been shrunk.

3. The rope substitution belt of claim 2 wherein at least said main body portion includes synthetic resin.

4. The rope substitution belt according to claim 1, wherein said belt portion has ground warps, and at about one third of said ground warps comprise said warp yarns of said hollow structure portion, and about two thirds of said ground warps comprise wadding yarns of said hollow structure portion.

5. The rope substitution belt according to claim 4, wherein a cross section through said hollow structure portion is circular.

6. The rope substitution belt according to claim 4, wherein said wadding yarns are woven into said belt portion in a single weave structure.

7. The rope substitution belt according to claim 4, wherein said wadding yarns are woven into said belt portion in a double weave structure.

8. The rope substitution belt according to claim 4, wherein said wadding yarns are woven into said belt portion in a triple weave structure.

9. The rope substitution belt according to claim 1, wherein said plurality of stages comprises at least three stages.

* * * * *